US005305067A

United States Patent [19]

Song

[11] Patent Number: 5,305,067

[45] Date of Patent: Apr. 19, 1994

[54] PHOTOSENSITIVE DRUM SURFACE CLEANING DEVICE FOR ELECTROCOPYING MACHINE

[75] Inventor: Yong I. Song, Yuoungki-do, Rep. of Korea

[73] Assignee: Hyundai Electronics Industries Co., Ltd., Japan

[21] Appl. No.: 82,946

[22] Filed: Jun. 29, 1993

[30] Foreign Application Priority Data

Jun. 30, 1992 [KR] Rep. of Korea ..... 92-11755

[51] Int. Cl.[5] ..... G03G 21/00

[52] U.S. Cl. ..... 355/297; 355/315; 271/310

[58] Field of Search ..... 355/296, 297, 299, 304, 355/315; 271/310

[56] References Cited

U.S. PATENT DOCUMENTS 4,060,235 11/1977 Weikel, Jr. ..... 271/310
4,295,734 10/1981 Tsuda et al. ..... 355/304
5,066,983 11/1991 Tonomoto ..... 355/297

FOREIGN PATENT DOCUMENTS 2-304475 12/1990 Japan .

*Primary Examiner*—Joan H. Pendegrass
*Attorney, Agent, or Firm*—Wigman, Cohen, Leitner & Myers

[57] ABSTRACT

A device for cleaning a surface of a photosensitive drum used in electrocopying machines utilizing a xerography, laser printers, and facsimiles using normal sheets. The cleaning device includes a filter unit having a suction fan and a duct connected to the suction fan at its one end, for sucking waste toner powder, the filter unit being disposed between the discharge plate and the blade, in place of a conventional separation pole, a roller disposed between the filter unit and the blade and adapted to be supplied with a cleaning agent via a cleaning agent supplying member, the roller having, at its circumferential portion, radially extending removal fibers with a predetermined length, a contact portion provided at the other end of the duct to have the same width as the duct and adapted to separate a copied sheet from the photosensitive drum, so that a double cleaning for the drum surface is carried out.

4 Claims, 2 Drawing Sheets

PHOTOSENSITIVE DRUM SURFACE CLEANING DEVICE FOR ELECTROCOPYING MACHINE

BACKGROUND OF THE INVENTION

1. Field of the Invention

The present invention relates to a device for cleaning a surface of a photosensitive drum used in electrocopying machines utilizing a xerography, laser printers, and facsimiles using normal sheets.

2. Description of the Prior Art

As a conventional device for cleaning a photosensitive drum, a construction has been known, which comprises a blade disposed in contact with a surface of the photosensitive drum and a roller type brush, so as to remove foreign materials attached to the drum surface. Such a construction is disclosed in Japanese Patent Laid-open Publication No. 90-304475.

By using this cleaning device, it is impossible to remove talcum powder separated from a surface or cut portion of a copied sheet and then attached to the drum surface. Where talcum powder is interposed between the blade and the drum, it scratches a photosensitive layer on the drum surface, since a friction occurs between the drum surface and the blade. The scratch may generate black lines upon copying. In more severe cases, the drum surface may be partially broken off, thereby resulting in a poor picture quality. As mentioned above, the conventional photosensitive drum cleaning device serves only to remove toner powder from the drum.

SUMMARY OF THE INVENTION

Therefore, an object of the invention is to eliminate the above-mentioned disadvantages encountered in the prior art and thus to provide a photosensitive drum surface cleaning device comprising a roller for removing foreign materials attached to the drum surface by sucking air between a discharge plate and a blade both arranged around the photosensitive drum, and a special roller for removing hard materials such as talcum powder from the drum surface.

In accordance with the present invention, this object can be accomplished by providing a photosensitive drum surface cleaning device for an electrocopying machine including a photosensitive drum, a discharge plate and a waste toner power removing blade both arranged around the photosensitive drum, said device being positioned around and near the photosensitive drum, to clean a surface of the photosensitive drum, the device comprising: a filter unit disposed between said discharge plate and said blade and having a suction fan and a duct connected to said suction fan at its one end, for sucking waste toner powder and separating a copied sheet from the photosensitive drum; a roller disposed between said filter unit and the blade and adapted to be supplied with a cleaning agent, said roller having, at its circumferential portion, radially extending removal fibers with a predetermined length; means for supplying said cleaning agent from an external cleaning agent source to the roller; a contact portion provided at the other end of said duct and having an inclined end provided with an inclined lower surface for separating said copied sheet from the photosensitive drum and an inclined upper surface formed with a plurality of protrusions for protecting the photosensitive drum; and a filter disposed at a middle portion of the duct. With this construction, it is possible to remove waste toner powder from the drum surface while protecting the drum.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
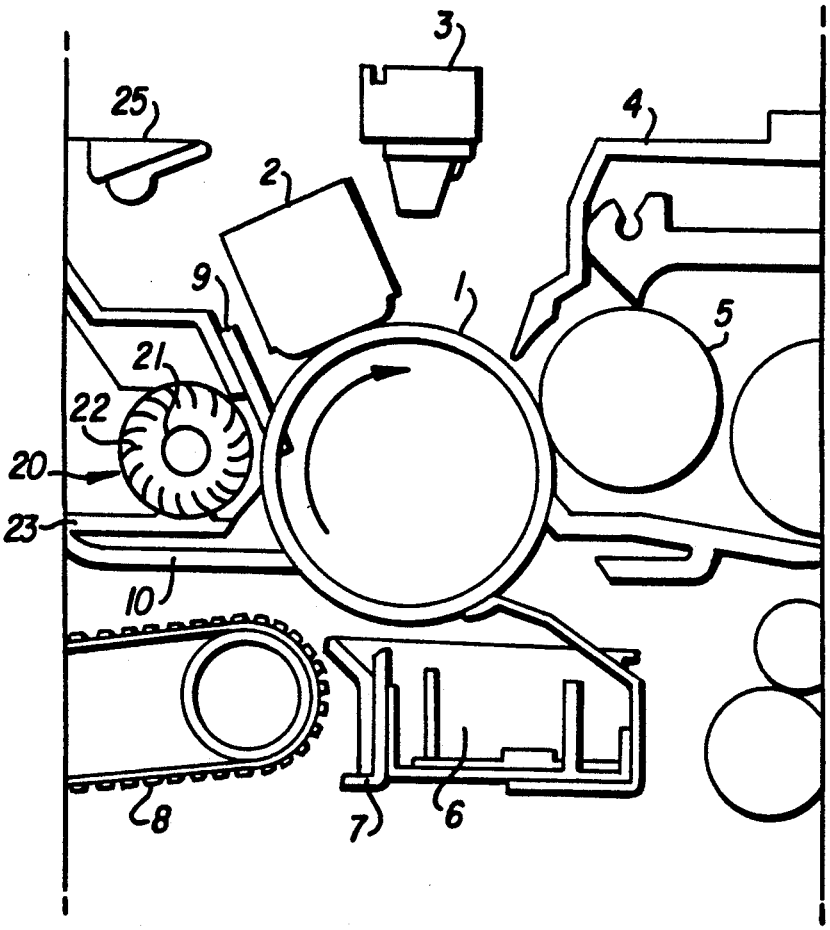
FIG. 1 is a schematic view of an electrocopying machine, showing its inner constructions arranged around a photosensitive drum.

Referring to FIG. 1, there is illustrated an inner construction of an existing electrocopying machine including a photosensitive drum and a blade housing surrounding the photosensitive drum. As shown in FIG. 1 , over and beneath the photosensitive drum which is denoted by the reference numeral 1, a corona charged body 2 and an image transferring corona charged body 6 are disposed, respectively. Adjacent to the corona charged body 2, a blank lamp 3 is positioned above the photosensitive drum 1. A development device 4 and a magnetic roller 5 are positioned between the blank lamp 3 and the corona charged body 6. Attached to the corona charged body 6 is a charge removing plate, namely, a discharge plate 7. Adjacent to the corona charged body 2, the blade housing supporting a blade 9 is disposed oppositely to the blank lamp 3.

In accordance with the present invention, a filter unit 10 is disposed between the blade housing and the discharge plate 7. The filter unit 10 is used, in place of a separation pole which has been disposed at the same position in accordance with the prior art, although not shown. In accordance with the present invention, a roller 20 is disposed in the blade housing. The roller 20 has removal fibers 22 at its circumferential surface. A cleaning agent supplying member 23 is also disposed beneath the roller 20 such that it is in contact with the roller 20.

Operation of the above-mentioned construction will now be described. In a copying operation, the photosensitive drum 1 rotates in a direction indicated by an arrow of FIG. 1, namely, in clockwise. At this time, the surface of the photosensitive drum 1 is charged by the corona charged body 2 and then radiated by the blank lamp 3. The charged and radiated surface of the photosensitive drum 1 then passes the development device 4 and the magnetic roller 5. Downstream of the magnetic roller 5, a copy sheet is fed to the photosensitive drum 1. Together with the copy sheet, the surface of photosensitive drum 1 then passes the image transferring corona charged body 6 and the discharge plate 7. Thereafter, the copy sheet is separated from the photosensitive drum 1 by the filter unit 10 and then discharged out of the copier by a belt conveyor 8 disposed between the discharge plate 7 and the filter unit 10. Then, the surface of photosensitive drum 1 free of the copy sheet passes the filter unit 10, the roller 20 and the blade 9.

In FIG. 1, the reference numeral 25 denotes a discharge lamp.

Figure 2:
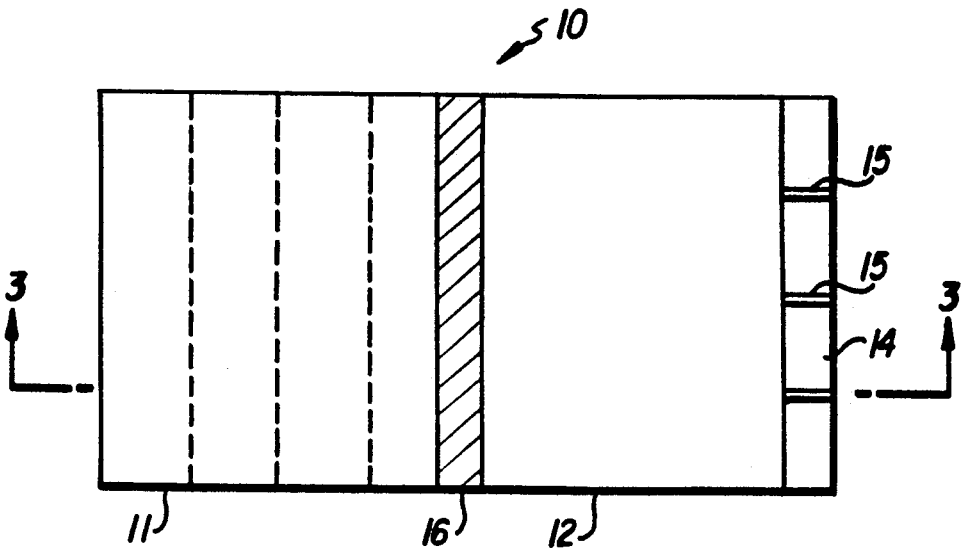
FIG. 2 is a plan view of a filter unit according to the present invention.
Figure 3:
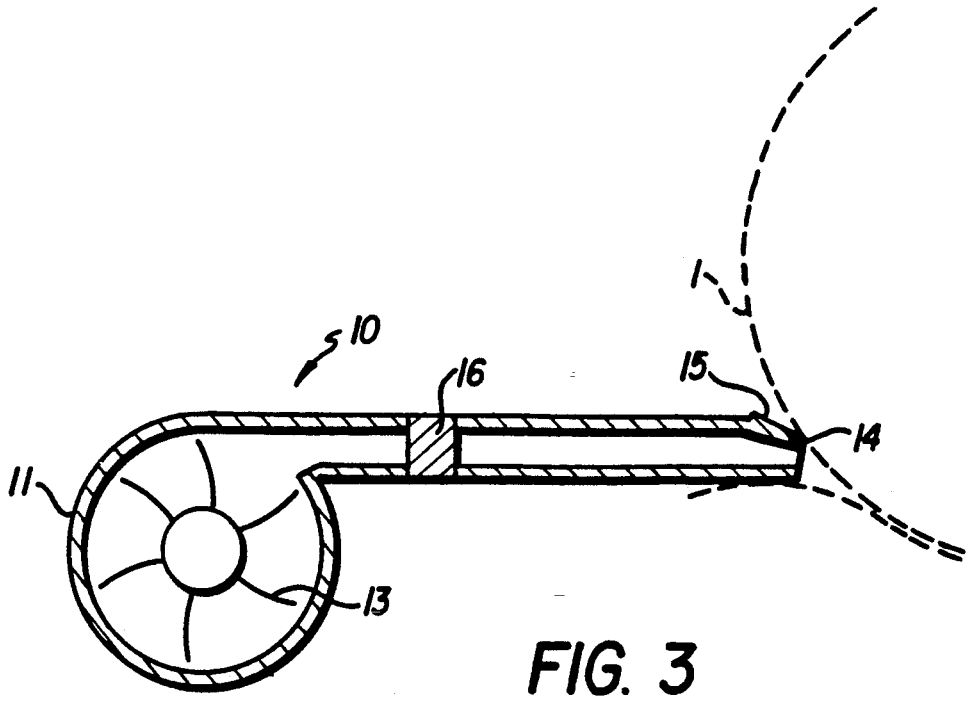
FIG. 3 is a cross-sectional view taken along the line A—A of FIG. 2.

FIGS. 2 and 3 are a plan view and a sectional view illustrating the filter unit 10 according to the present invention. As shown in the drawings, the filter unit 10 comprises a cylindrical filter unit housing 11 and a suction fan 13 disposed in the filter unit housing 11 and driven by a motor (not shown) externally mounted. Connected to the upper end of the housing 11 is a duct 12 which has a width identical to the width of the housing 11. The width of duct 12 is also identical to the length or width of the photosensitive drum 1. The duct 12 has a contact portion 14 at the upper surface of its front end. The contact portion 14 is made of a soft material such as Teflon. A plurality of uniformly spaced protrusions 15 are formed at the upper surface of the contact portion 14. The upper surface of the contact portion 14 has an inclined surface portion at its front end, so as to protect the surface of photosensitive drum 1. The contact portion 14 also has an inclined surface portion at its lower surface, so as to separate the copied sheet from the surface of photosensitive drum 1, as indicated by a dotted line of FIG. 3. At the middle portion of the duct 12, a filter 16 is disposed, which extends throughout the width of the duct 12. The filter 16 has a double-layered structure including a layer for removing an ozone gas and a layer for removing foreign materials.

In accordance with the present invention, the roller 20 is disposed between the filter unit 10 and the blade 9, as mentioned above in conjunction with FIG. 1. The provision of the roller 20 is required, in that foreign materials attached to the surface of photosensitive drum 1 may be imperfectly removed only by the filter unit 10.

The roller 20 may be positioned in parallel to a brush conventionally mounted.

The roller 20 comprises a cylindrical elongated shaft 21 around which the removal fibers 22 each having a proper length are attached to extend radially. The cleaning agent supplying member 23 which is disposed beneath and in contact with the roller 20 serves to supply a cleaning agent to the roller 20 such that the cleaning agent permeates among the removal fibers 22 in a proper amount. Accordingly, the roller 20 can serve to not only brush off the surface of photosensitive drum 1, but also smoothly wipe the surface of photosensitive drum 1 to remove hard materials such as talcum powder attached to the drum surface by the cleaning agent.

Where a liquid having a sufficient viscosity for making foreign materials on the drum surface adhere thereto and exhibiting a high electrical insulation property is used as the cleaning agent, it is possible to clean the drum surface more effectively. It is also understood by skilled men that the cleaning agent should be replaced by new one after its use for a proper period. In this connection, it is preferred that the cleaning agent supplying member 23 has a container construction having a partially opened top portion to be in contact with the circumferential roller surface beneath the roller 20.

In accordance with the present invention, the filter unit 10 also serves as a secondary discharge member for performing a secondary discharge to a copied sheet which has been primarily subjected to a discharge by the discharge plate 7. Although an attraction force remains at the copied sheet even after the double discharging treatments, the copied sheet can be easily separated from the photosensitive drum 1, in that the contact portion 14 formed at the front end of the duct 12 has the inclined upper surface for forcibly separating the sheet from the photosensitive drum 1.

The protrusions 15 are constructed to be protruded in multiple from the upper surface of the contact portion 14, longitudinally of the duct 12, and thus to protect the photosensitive drum 1 and the duct 12. Also, the filter unit 10 performs a cleaning function for removing foreign materials attached to the drum surface, by virtue of a suction force generated from the suction fan 13 mounted in the filter unit housing 11 and transmitted through the duct 12.

It is desirable that the contact portion 14 of the filter unit 10 is positioned away from the surface of the photosensitive drum 1 at a normal state and comes into contact with the drum surface only when a copy sheet is supplied to the drum surface. This operation is similar to the operation of conventional separation pole and thus its detailed description is omitted. Thus, the contact portion 14 of the filter unit 10 performs the function of the conventional separation pole as well as the copied sheet separation function.

As apparent from the above description, the cleaning device of the present invention comprises a filter unit for sucking foreign materials such as toner powder and dust attached to a drum surface, to remove them, and separating a copied sheet from the drum surface. The cleaning device also comprises a roller 20 for additionally removing hard materials such as talcum powder attached to the drum surface. With these provisions, there is no problem of damaging the drum surface by talcum powder interposed between the drum and the blade, which problem was encountered in conventional devices. In accordance with the present invention, a superior drum cleaning effect can be obtained, in that the filter unit removes foreign materials attached to the drum surface in an air suction manner.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A photosensitive drum surface cleaning device for an electrocopying machine including a photosensitive drum, a discharge plate and a waste toner power removing blade both arranged around the photosensitive drum, said device being positioned around and near the photosensitive drum, to clean a surface of the photosensitive drum, the device comprising:

a filter unit disposed between said discharge plate and said blade and having a suction fan and a duct connected to said suction fan at its one end, for sucking waste toner powder and separating a copied sheet from the photosensitive drum;

a roller disposed between said filter unit and the blade and adapted to be supplied with a cleaning agent, said roller having, at its circumferential portion, radially extending removal fibers with a predetermined length;

means for supplying said cleaning agent from an external cleaning agent source to the roller;

a contact portion provided at the other end of said duct and having an inclined end; and a filter disposed at a middle portion of the duct.

2. A photosensitive drum surface cleaning device in accordance with claim 1, wherein said duct of the filter unit has the same width as the photosensitive drum and said filter has the same width as the duct.

3. A photosensitive drum surface cleaning device in accordance with claim 1, wherein said inclined end of the contact portion has an inclined lower surface for separating said copied sheet from the photosensitive drum and an inclined upper surface provided with a plurality of protrusions for protecting the photosensitive drum.

4. A photosensitive drum surface cleaning device in accordance with claim 1, wherein said cleaning agent supplying means comprises a cleaning agent supplying member disposed at a position where it is in contact with a circumferential surface of said roller beneath the roller.

* * * * *